US010418003B2

(12) United States Patent
Taniguchi

(10) Patent No.: US 10,418,003 B2
(45) Date of Patent: Sep. 17, 2019

(54) KEYBOARD DEVICE AND KEYBOARD INSTRUMENT

(71) Applicant: CASIO COMPUTER CO., LTD., Shibuya-ku, Tokyo (JP)

(72) Inventor: Hirokazu Taniguchi, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/920,084

(22) Filed: Mar. 13, 2018

(65) Prior Publication Data

US 2018/0268787 A1 Sep. 20, 2018

(30) Foreign Application Priority Data

Mar. 17, 2017 (JP) ..... 2017-052433

(51) Int. Cl.
*G10C 3/18* (2006.01)
*G10C 3/04* (2006.01)
*G10C 3/12* (2006.01)

(52) U.S. Cl.
CPC ..... *G10C 3/18* (2013.01); *G10C 3/04* (2013.01); *G10C 3/12* (2013.01)

(58) Field of Classification Search
CPC ..... G10C 3/18; G10C 3/04; G10C 3/12
See application file for complete search history.

(56) References Cited

U.S. PATENT DOCUMENTS 476,766 A 7/1892 Kringle
6,423,889 B2 * 7/2002 Inoue ..... G10C 3/22 84/236
6,649,821 B2 11/2003 Inoue
(Continued)

FOREIGN PATENT DOCUMENTS

JP 62502781 A 10/1987
JP 07261749 A 10/1995
(Continued)

OTHER PUBLICATIONS

Related U.S. Appl. No. 15/919,920; First Named Inventor: Hirokazu Taniguchi; Title: "Keyboard Device and Keyboard Instrument"; filed Mar. 13, 2018.
(Continued)

*Primary Examiner* — Robert W Horn
(74) *Attorney, Agent, or Firm* — Holtz, Holtz & Volek PC

(57) ABSTRACT

A keyboard device is provided whose entire device body can be compactified even if a hammer member length in its front and rear direction is increased and a keyboard instrument including the keyboard device. The keyboard device includes a plurality of keys, a transmission member which is rotated in response to a key depression operation performed on a key among the plurality of keys, and a hammer member which is rotated in response to rotation of the transmission member and applies an action load to the key, in which the hammer member includes a hammer arm and a hammer head provided on a front side of the hammer arm, and the hammer arm is rotated around a hammer rotation center located on a rear side of the hammer arm in response to the key depression operation performed on the key.

10 Claims, 7 Drawing Sheets

(56) References Cited

U.S. PATENT DOCUMENTS

| | | | | |
|---|---|---|---|---|
| 6,683,242 | B2 * | 1/2004 | Inoue | G10C 5/10 84/719 |
| 6,888,052 | B2 | 5/2005 | Meisel | |
| 7,145,062 | B2 | 12/2006 | Ishida | |
| 7,193,147 | B2 * | 3/2007 | Ishida | G10C 3/12 84/35 |
| 7,345,235 | B2 * | 3/2008 | Izutani | G10C 3/12 84/718 |
| 7,807,911 | B2 | 10/2010 | Izutani et al. | |
| 7,999,162 | B2 * | 8/2011 | Izutani | G10C 3/12 84/174 |
| 8,541,673 | B2 * | 9/2013 | Jones | G10C 5/10 84/243 |
| 9,006,549 | B2 * | 4/2015 | Suzuki | G10H 1/34 84/423 R |
| 9,324,306 | B2 * | 4/2016 | Hoshino | G10C 3/22 |
| 9,384,715 | B2 * | 7/2016 | Taniguchi | G10C 3/18 |
| 9,495,940 | B2 * | 11/2016 | Hoshino | G10C 3/18 |
| 9,607,587 | B2 * | 3/2017 | Suzuki | G10H 1/34 |
| 2006/0207404 | A1 * | 9/2006 | Izutani | G10C 3/12 84/174 |
| 2014/0083274 | A1 * | 3/2014 | Abe | G10C 3/16 84/251 |
| 2018/0268786 | A1 * | 9/2018 | Taniguchi | G10C 3/04 |
| 2018/0268787 | A1 * | 9/2018 | Taniguchi | G10C 3/18 |
| 2018/0277081 | A1 * | 9/2018 | Taniguchi | G10H 1/346 |
| 2019/0019484 | A1 * | 1/2019 | Taniguchi | G10C 3/12 |

FOREIGN PATENT DOCUMENTS

| | | | |
|---|---|---|---|
| JP | 10039857 | A | 2/1998 |
| JP | 2002258835 | A | 9/2002 |
| JP | 2005049789 | A | 2/2005 |
| JP | 2008090167 | A | 4/2008 |
| JP | 2015079268 | A | 4/2015 |

OTHER PUBLICATIONS

Notice of Allowance dated Mar. 20, 2019 issued in U.S. Appl. No. 15/919,920.

* cited by examiner

KEYBOARD DEVICE AND KEYBOARD INSTRUMENT

CROSS-REFERENCE TO RELATED APPLICATION

This application is based upon and claims the benefit of priority from the prior Japanese Patent Application No. 2017-052433, filed Mar. 17, 2017, the entire contents of which are incorporated herein by reference.

BACKGROUND OF THE INVENTION

1. Field of the Invention

The present invention relates to a keyboard device for use in a keyboard instrument such as a piano, and a keyboard instrument including the keyboard device.

2. Description of the Related Art

For example, a keyboard device such as a piano is known which includes keys that are supported on a base plat in a manner to be rotatable in a vertical direction by balance pins serving as key support shafts, wippens that are rotated by key depression operations performed on the keys, jacks that are driven in response to the rotating motions of the wippens, and hammer members that are driven by the jacks and strike strings, and has a structure where the wippens, the jacks, and the hammer members are provided corresponding to the plurality of keys, as described in Japanese Patent Application Laid-Open (Kokai) Publication No. 2002-258835.

This type of keyboard device is structured such that each hammer member, which is rotated by a jack driven in response to the rotating motion of a wippen by a key depression operation on a key, includes a hammer arm and a hammer head, its hammer rotation center at one end of the hammer arm is arranged closer to a rear portion of the key than an area above a balance pin which supports the key, and the hammer head at the other end of the hammer arm is arranged above a substantially rear end of the key.

In this keyboard device, if the length of the hammer member in the front and rear direction is formed large without the position of the hammer rotation center on the hammer arm being changed, the hammer head projects backward from the rear end of the key, and the length of the entire keyboard device in the front and rear direction of the key becomes large. However, there is a need to compactify the entire keyboard device.

An object of the present invention is to provide a keyboard device whose entire size is compact even when the lengths of its hammer members in a front and rear direction are formed larger, and a keyboard instrument including this keyboard device.

SUMMARY OF THE INVENTION

In accordance with one aspect of the present invention, there is provided a keyboard device comprising: a plurality of keys; a transmission member which is rotated in response to a key depression operation performed on a key among the plurality of keys; and a hammer member which is rotated in response to rotation of the transmission member and applies an action load to the key, wherein the hammer member includes a hammer arm and a hammer head provided on a front side of the hammer arm, and wherein the hammer arm is rotated around a hammer rotation center located on a rear side of the hammer arm in response to the key depression operation performed on the key.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more clearly understood by the detailed description below being considered together with the following drawings.

FIG. 4A and FIG. 4B are diagrams showing portions of a transmission member and a transmission holding member shown in FIG. 2, of which FIG. 4A is an enlarged planar view thereof and FIG. 4B is an enlarged sectional view of the main section thereof taken along line B-B in FIG. 4A;

FIG. 5A and FIG. 5B are diagrams showing the transmission member shown in FIG. 2, of which FIG. 5A is an enlarged side view thereof and FIG. 5B is an enlarged sectional view thereof taken along line C-C in FIG. 5A;

FIG. 6A and FIG. 6B are diagrams showing portions of a hammer member and a hammer holding member shown in FIG. 2, of which FIG. 6A is an enlarged plan view thereof, and FIG. 6B is an enlarged sectional view of the main section thereof taken along line D-D in FIG. 6A; and FIG. 7A and FIG. 7B are diagrams showing the hammer member shown in FIG. 2, of which FIG. 7A is an enlarged side view thereof, and FIG. 7B is an enlarged plan view thereof.

DETAILED DESCRIPTION OF THE PREFERRED EMBODIMENTS

An embodiment in which the present invention has been applied in an electronic keyboard instrument will hereinafter be described with reference to FIG. 1 to FIG. 7.

Figure 1:
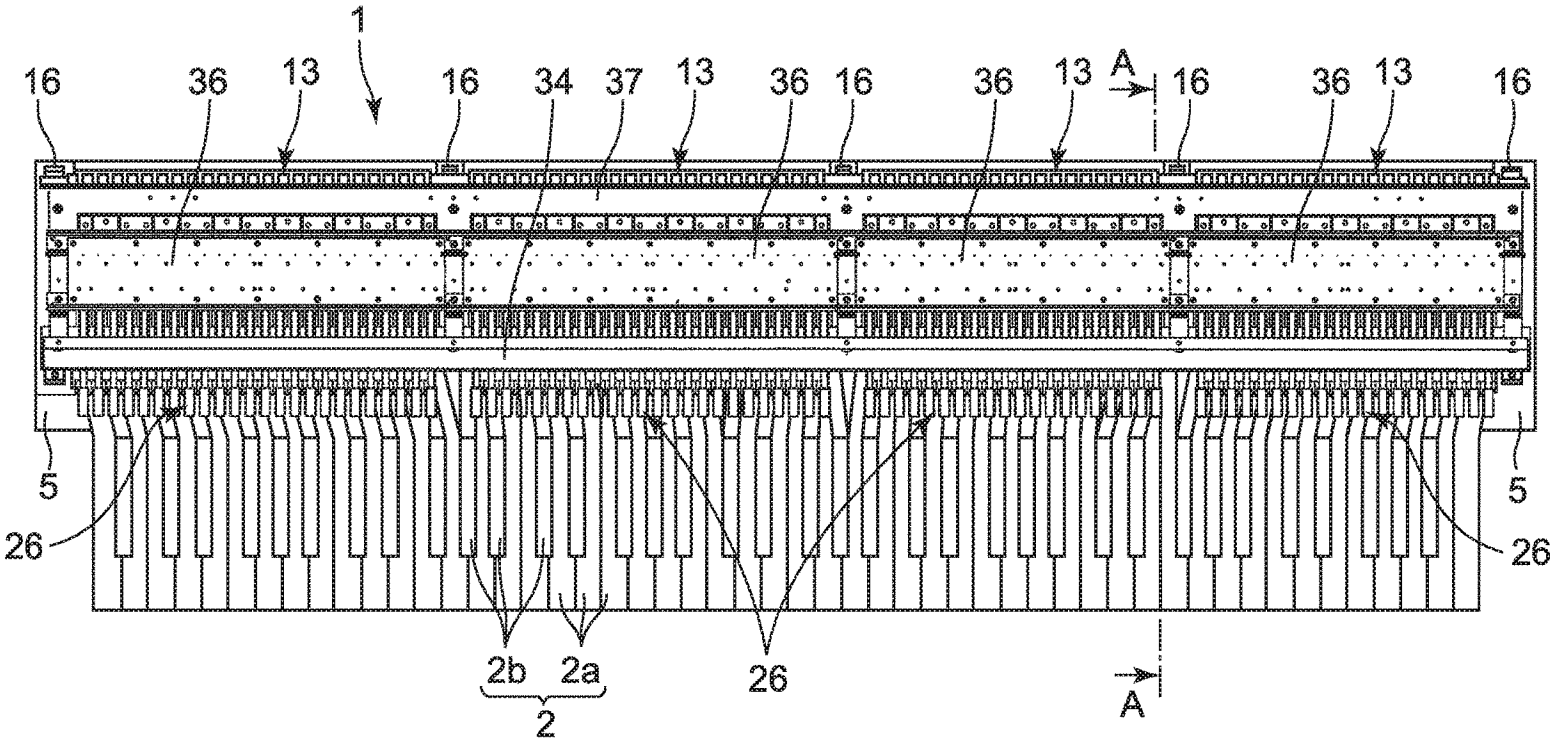
FIG. 1 is a planar view showing a keyboard device according to an embodiment where the present invention has been applied in an electronic keyboard instrument.
Figure 2:
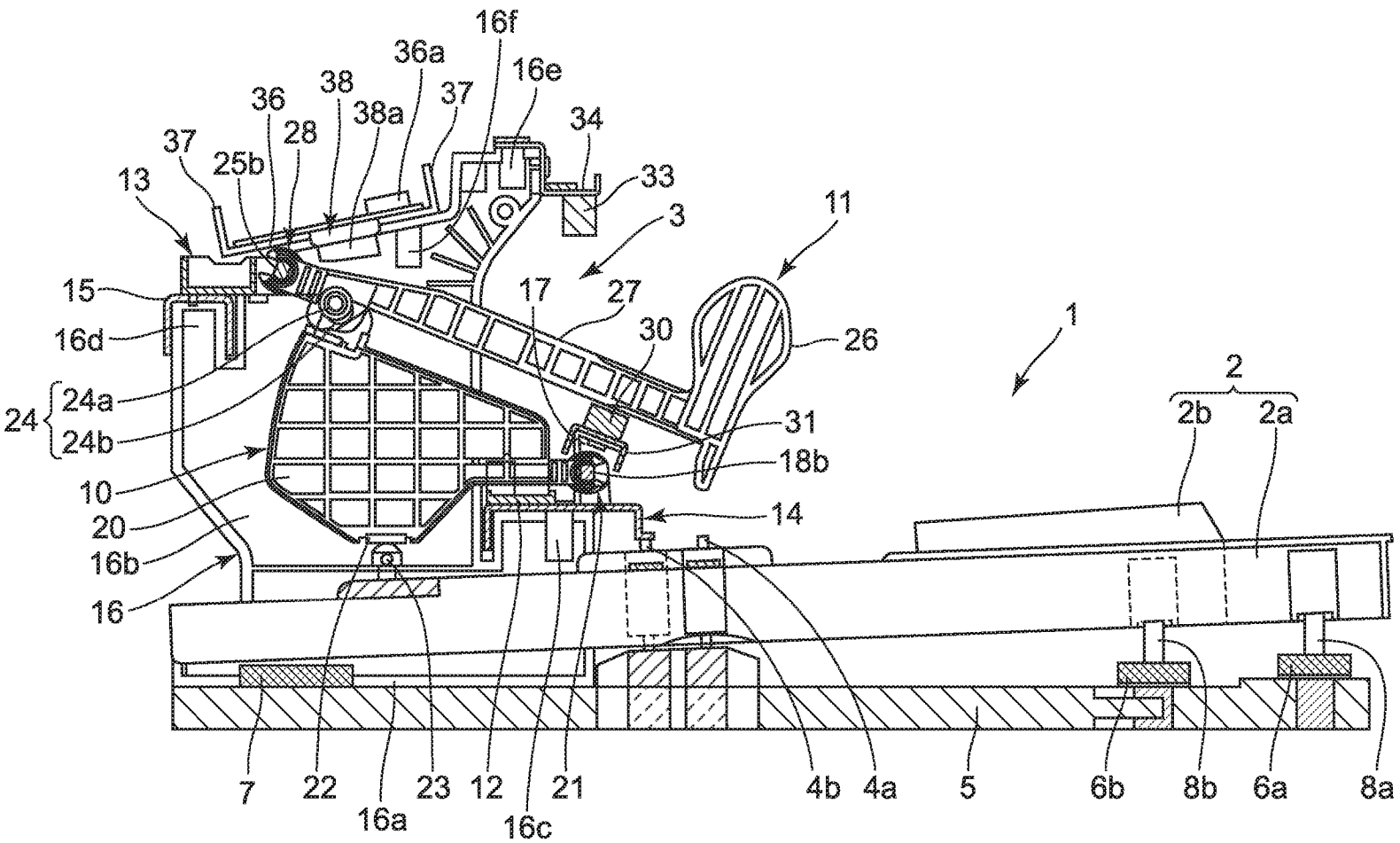
FIG. 2 is an enlarged sectional view of the keyboard device taken along line A-A in FIG. 1.
Figure 3:
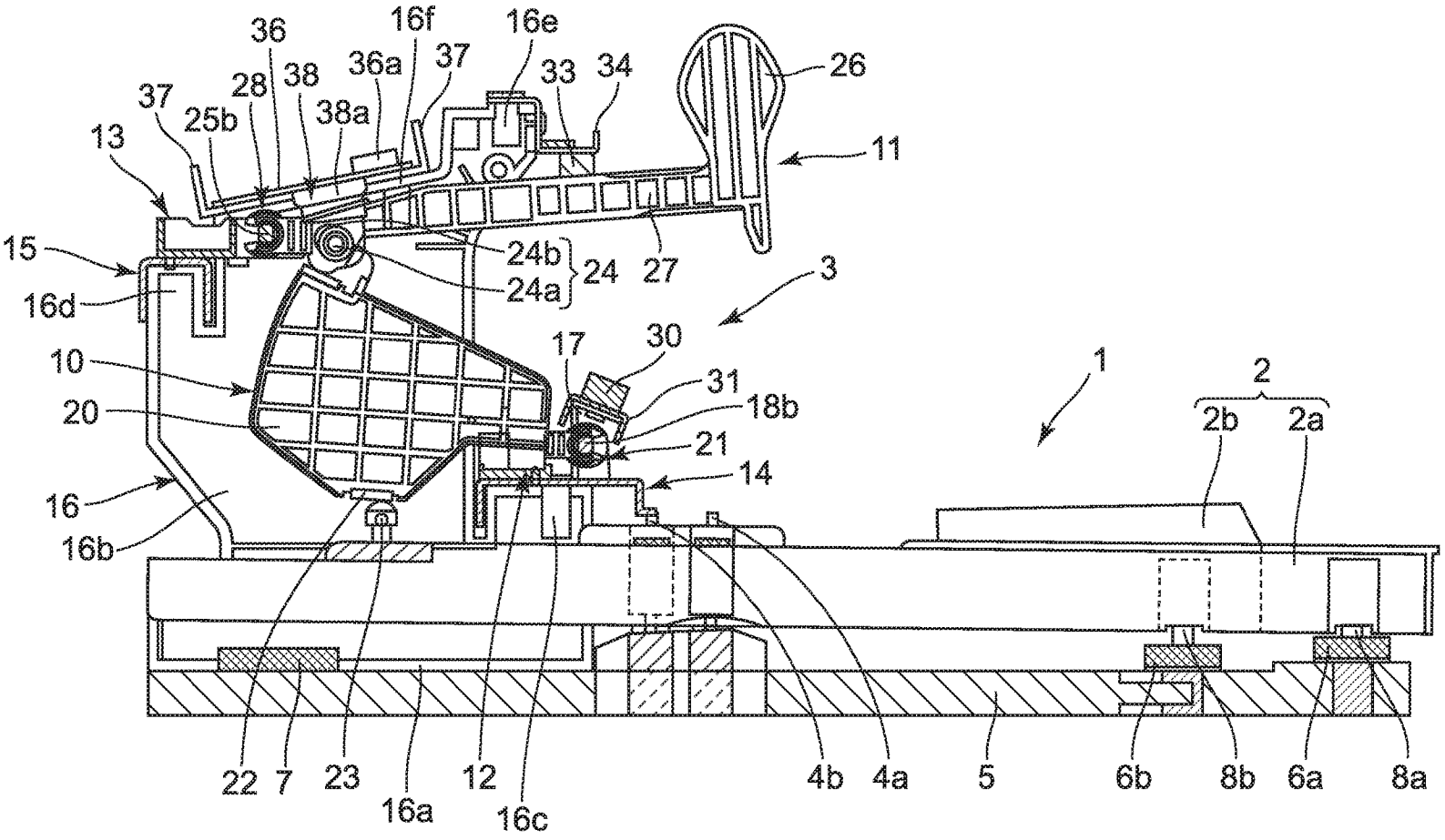
FIG. 3 is an enlarged sectional view showing a state where a key in the keyboard device shown in FIG. 2 has been depressed.

This electronic keyboard instrument includes a keyboard device 1, as shown in FIG. 1 to FIG. 3. This keyboard device 1, which is incorporated into an instrument case (not shown), includes a plurality of keys 2 arranged in parallel and action mechanisms 3 each of which applies an action load to the corresponding one of the plurality of keys 2 in response to a key depression operation on the corresponding key 2.

The plurality of keys 2 includes white keys 2*a* and black keys 2*b*, as shown in FIG. 1 to FIG. 3. The total number of white keys 2*a* and black keys 2*b* arranged in parallel is 88, for example. By a balance pin 4*a* or 4*b* serving as a key support shaft, a substantially intermediate portion of each key 2 in a front and rear direction (a lateral direction in FIG. 2) is supported such that it is rotatable in a vertical direction. In this state, the keys 2 are arranged in parallel on a base plate 5.

That is, the white keys 2*a* and the black keys 2*b* have different lengths in the front and rear direction, and the lengths of the white keys 2*a* are larger than the lengths of the black keys 2*b*, as shown in FIG. 1 to FIG. 3. In this embodiment, the white keys 2*a* and the black keys 2*b* are arranged such that their rear ends (left ends in FIG. 2) are aligned with each other. Also, the white keys 2*a* are supported on the base plate 5 by the balance pins 4*a* serving as key support shafts, and the black keys 2*b* are supported on the base plate 5 by the balance pins 4*b* serving as key support shafts.

Accordingly, on the base plate 5, cushion members 6*a* for the white keys 2*a* and cushion members 6*b* for the black keys 2*b* with which the under surfaces of front end portions (right end portions in FIG. 2) of the plurality of keys 2 separably come in contact are provided along the array direction of the keys 2, as shown in FIG. 2 and FIG. 3. Also, on the base plate 5, cushion members 7 with which the under surfaces of rear end portions (left end portions in FIG. 2) of the plurality of keys 2 separably come in contact are provided along the array direction of the keys 2.

As a result, for each of the plurality of keys 2, a key stroke is set by a cushion member 6*a* or 6*b* on the front side thereof and a cushion member 7 on the rear side thereof, as shown in FIG. 2 and FIG. 3. Further, on the base plate 5, guide pins 8*a* for the white keys 2*a* and guide pins 8*b* for the black keys 2*b* for preventing the plurality of keys 2 from rolling in the array direction of the keys 2 are provided upright.

The action mechanisms 3 include a plurality of transmission members 10 each of which is rotated in the vertical direction in response to a key depression operation on the corresponding one of the plurality of keys 2, and a plurality of hammer members 11 each of which is rotated in the vertical direction in response to the rotating motion of the corresponding one of the plurality of transmission members 10 and applies an action load to the corresponding one of the plurality of keys 2, as shown in FIG. 2 to FIG. 3. In this embodiment each key 2 is rotated in the counterclockwise direction around a balance pin 4*a* or 4*b* by the weight of the corresponding one of the plurality of transmission members 10, so that an initial load is applied to each key 2 by it being pressed up to its initial position.

Also, the action mechanisms 3 include a plurality of transmission holding members 12 each of which rotatably holds the corresponding one of the plurality of transmission members 10 and a plurality of hammer holding members 13 each of which rotatably holds the corresponding one of the plurality of hammer members 11, as shown in FIG. 2 and FIG. 3. The plurality of transmission holding members 12 are mounted on a transmission support rail 14 arranged along the array direction of the keys 2. Also, the plurality of hammer holding members 13 are mounted on a hammer support rail 15 arranged along the array direction of the keys 2.

The transmission support rail 14 and the hammer support rail 15 are supported by the plurality of rail support members 16 and arranged above the plurality of keys 2, as shown in FIG. 2 and FIG. 3. The plurality of rail support members 16 are mounted upright on the base plate 5 such that they are positioned in a plurality of predetermined areas located over the entire length of the base plate 5 in the array direction of the keys 2, as shown in FIG. 1.

In this embodiment, the plurality of keys 2 includes a total of 38 keys 2, as shown in FIG. 1. Accordingly, the plurality of rail support members 16 are respectively arranged in a plurality of areas including both end areas in the array direction of the plurality of keys 2 and three areas located, for example, every twenty keys 2 and positioned between keys 2. That is in the present embodiment the rail support members 16 are arranged in the five areas over the entire length of the keys 2 in the array direction.

Each of the plurality of rail support members 16 is constituted by hard synthetic resin such as ABS (Acrylonitrile Butadiene Styrene) resin, and has a mounting section 16*a* mounted on the base plate 5 and a bridge section 16*b* integrally formed on the mounting section 16*a*, as shown in FIG. 2 and FIG. 3. As a result, the rail support members 16 are arranged in areas corresponding to rear portions of the plurality of keys 2 with the bridge sections 16*b* projecting above the keys 2 by the mounting sections 16*a* being mounted on the base plate 5.

In this embodiment, on lower front portions of the bridge sections 16*b*, that is, on upper front portions (upper right portions in FIG. 2) of the mounting sections 16*a*, transmission rail support sections 16*c* are provided which support the transmission support rail 14 above an area behind the balance pins 4*a* and 4*b* serving as key support shafts, as shown in FIG. 2 and FIG. 3. Also, on upper rear portions (upper left portions in FIG. 2) of the bridge sections 16*b*, hammer rail support sections 16*d* are provided which support the hammer support rail 15 above the rear ends of the keys 2.

Moreover, stopper rail support sections 16*e*, which hold an upper-limit stopper rail 34 described later, are provided on upper front portions (upper right portions in FIG. 2) of the bridge sections 16*b*, as shown in FIG. 2 and FIG. 3. Furthermore, substrate rail support sections 16*f*, which hold a substrate support rail 37 described later, are provided on upper end portions of the bridge sections 16*b*.

The transmission support rail 14 is formed by both side portions of a band plate being folded downward along its longitudinal direction, and is provided over the entire length of the plurality of keys in the array direction 2, as shown in FIG. 2 and FIG. 3. Plural portions (five areas) of this transmission support rail 14 in the array direction of the keys 2 are mounted on the transmission rail support sections 16*c* of the plurality of rail support members 16.

As a result, the transmission support rail 14 is arranged above the area behind the balance pins 4*a* and 4*b* which support the keys 2 as shown in FIG. 2 and FIG. 3, and the bottom of the front end (the bottom on the right side in FIG. 2) of the transmission support rail 14 is arranged and supported on upper end portions of the balance pins 4*b* for the black keys 2*b* in this state.

On this transmission support rail 14, the plurality of transmission holding members 12 and a plurality of stopper support sections 17 are mounted along the array direction of the keys 2, as shown in FIG. 2 and FIG. 3. In this case, the plurality of stopper support sections 17 are each constituted by a metal plate, and are mounted in predetermined areas (five areas) on the transmission support rail 14 corresponding to the plurality of rail support members 16 with them projecting above the plurality of transmission holding members 12.

Figure 4A:
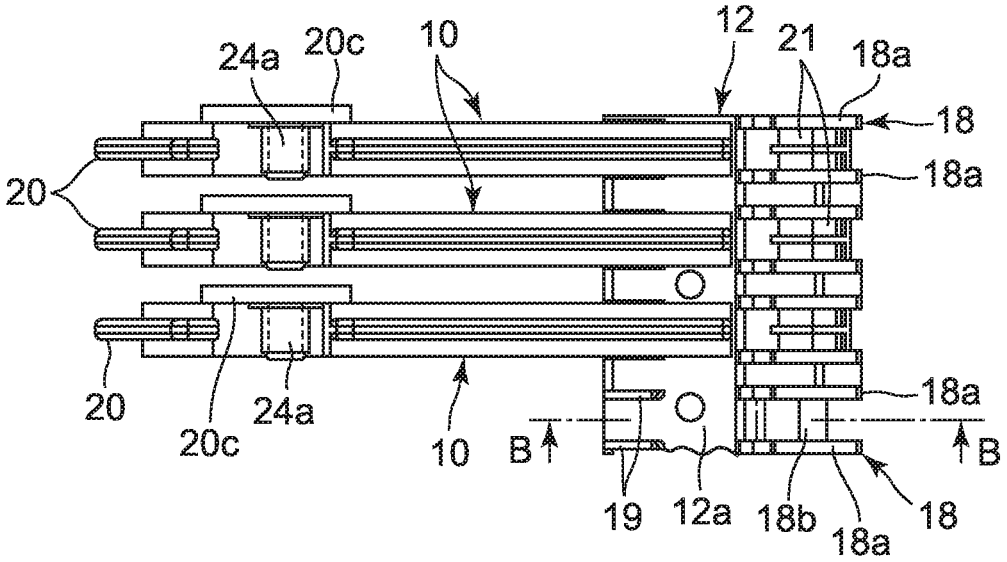

Each transmission holding member 12 is constituted by hard synthetic resin such as ABS resin, and includes a body plate 12*a* and a plurality of shaft support sections 18, as shown in FIG. 4A and FIG. 48. On the body plate 12*a*, the plurality of shaft support sections 18 are integrally provided along the array direction of the keys 2 with them respectively corresponding to, for example, ten keys 2. Each of the shaft support sections 18 prevents the rolling of the corresponding transmission member 10 by the transmission member 10 being rotatably mounted thereon.

Figure 4B:
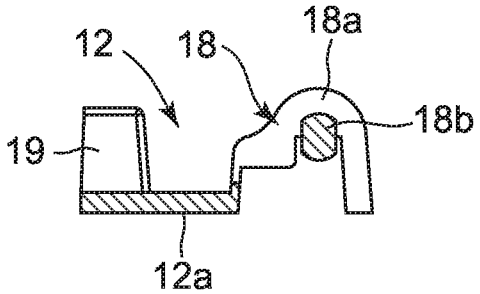

That is, each shaft support section 18 has a pair of guide walls 18*a* and a transmission holding shaft 18*b* provided between the pair of guide walls 18*a*, as shown in FIG. 4A and FIG. 4B. These guide walls 18*a* are provided corresponding to the plurality of transmission members 10, on a front end portion (a right end portion in FIG. 4A) of the body plate 12*a* of the corresponding transmission holding member 12.

The pair of guide walls 18*a* serves as a guide section which rotatably guides a transmission fitting section 21 of the corresponding transmission member 10 with the transmission fitting section 21 of the transmission member 10 being slidably interposed therebetween, as shown in FIG. 4A. The transmission holding shaft 18*b* has a substantially round-bar shape and has a non-circular shape in cross section because both sides of its outer peripheral surface are cut out, as shown in FIG. 4B. The transmission holding shaft 18*b* is arranged above the area behind the balance pins 4*a* and 4*b* which support the keys 2, as shown in FIG. 2 and FIG. 3.

Also, each transmission holding member 12 includes a regulating section 19 which regulates the rolling of the corresponding transmission member 10 when the keyboard device 1 is packaged and transported, as shown in FIG. 4A and FIG. 4B. The regulating section 19 is a pair of regulating walls provided on a rear portion (a left side portion in FIG. 4A) of the body plate 12*a* of the transmission holding member 12 in a manner to correspond to the transmission member 10. The regulating section 19 regulates the rolling of the transmission member 10 when the keyboard device 1 is packaged and transported, in addition to rotatably guiding the transmission member 10 with a lower front portion of the transmission member 10 being interposed therebetween.

Each transmission member 10 is constituted by hard synthetic resin such as ABS resin, and includes the transmission body section 20 which is rotated in the vertical direction in response to a key depression operation on the corresponding key 2 so as to rotate the corresponding hammer member 11 in the vertical direction, and the transmission fitting section 21 serving as a rotation holding section provided integrally with the transmission body section 20 and rotatably mounted on the transmission holding shaft 18*b* of the corresponding transmission holding member 12, as shown in FIG. 2 to FIG. 5.

Figure 5A:
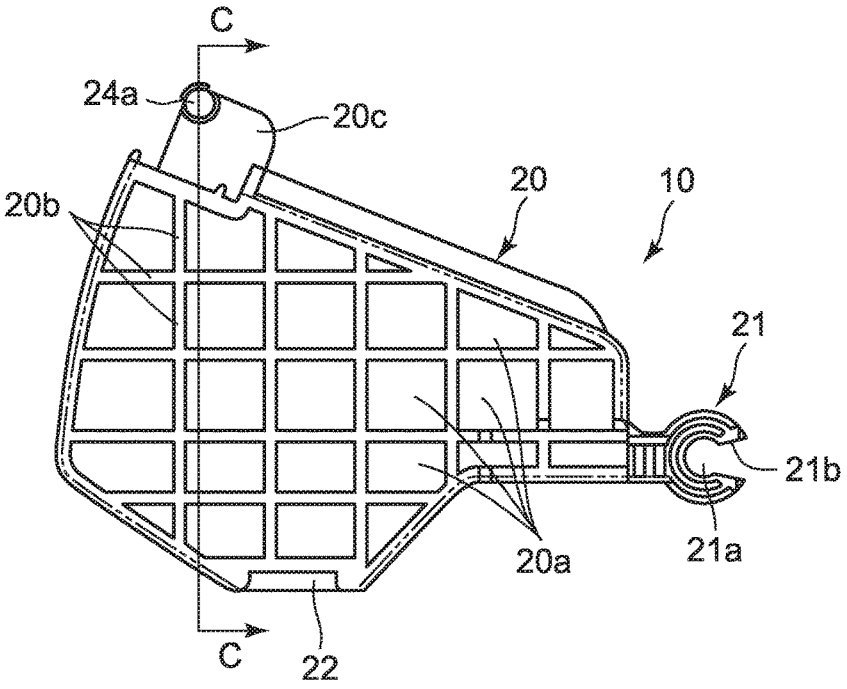
Figure 5B:
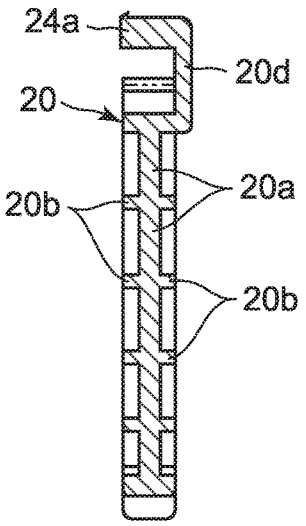

The transmission body section 20 is formed in a substantially waffle shape, as shown in FIG. 5A and FIG. 5B. That is, the transmission body section 20 has a thin vertical plate section 20*a* and a plurality of rib sections 20*b* provided in a substantially lattice shape on an outer peripheral portion and both side surfaces of the vertical plate section 20*a*, which form a waffle shape. In this case, the transmission body section 20 is structured such that the weight of the transmission member 10 is adjusted by the shape and thickness of the vertical plate section 20*a* and the formation density of the plurality of rib sections 20*b*.

Also, each transmission member 10 is structured such that its rigidity is ensured by the plurality of rib sections 20*b* even though the vertical plate section 20*a* of the transmission body section 20 is thin, and that the occurrence of a shrink in the vertical plate section 20*a* when it is formed of synthetic resin is prevented by the plurality of rib sections 20*b*, as shown in FIG. 5A and FIG. 5B.

The transmission fitting section 21 is formed in a C shape as a whole, and is provided projecting forward on a front end portion (a right end portion in FIG. 5A) of the transmission body section 20, as shown in FIG. 2, FIG. 3, and FIG. 5. That is the transmission fitting section 21 is provided such that its thickness in the array direction of the keys 2 is substantially equal to a length between the pair of guide walls 18*a* of the corresponding shaft support section 18, and is slidably inserted between the pair of guide walls 18*a*, as shown in FIG. 5A.

Also, this transmission fitting section 21 has a fitting hole 21*a* which is provided in its center and into which the transmission holding shaft 18*b* of the transmission holding member 12 is to be fitted, as shown in FIG. 5A. This fitting hole 21*a* is a transmission rotation center of the transmission member 10. In addition, the transmission fitting section 21 has an insertion port 21*b* which is provided in its portion around the fitting hole 21*a*, i.e., its front portion around the fitting hole 21*a* and into which the transmission holding shaft 18*b* is removably inserted.

As a result, the transmission fitting section 21 is rotatably mounted on the transmission holding shaft 18*b* when the transmission holding shaft 18*b* is inserted into the fitting hole 21*a* via the insertion port 21*b*, as shown in FIG. 2 and FIG. 3. In this case, the transmission fitting section 21 is arranged above the area behind the balance pins 4*a* and 4*b* which support the keys 2.

Also, a lower portion of the transmission body section 20 of the transmission member 10 projects toward the upper surface of the key 2, as shown in FIG. 2, FIG. 3, and FIG. 5. In a lower end portion of the transmission body section 20, a transmission felt 22 is provided. This transmission felt 22 comes in contact with a capstan 23 provided on an upper rear portion of the key 2 from above.

As a result, when the key 2 is depressed, the transmission member 10 is rotated around the transmission holding shaft 18*b* in the clockwise direction by the transmission felt 22 being pressed upward by the capstan 23 on the key 2, as shown in FIG. 2 and FIG. 3. Also, the transmission body section 20 of the transmission member 10 is provided such that its upper rear end is higher than its upper front end, and therefore its upper side portion is inclined downward and frontward (rightward FIG. 2).

On the upper rear end of the transmission body section 20, a support section 20*c* is provided projecting upward, as shown in FIG. 2, FIG. 3, and FIG. 5A. That is, the support section 20*c* is moved in the vertical direction along a side surface of the hammer member 11 without coming in contact with the hammer member 11. Also, on a side surface of the support section 20*c*, an interlock projecting section 24*a* of an interlock control section 24 described below is provided.

On the other hand, as with the transmission support rail 14, the hammer support rail 15 has a shape formed by both side portions of a band plate being folded downward along its longitudinal direction, and is provided over the entire length of the plurality of keys 2 in the array direction, as shown in FIG. 1 to FIG. 3. Plural (five) portions of this hammer support rail 15 located in the array direction of the keys 21 are mounted on the hammer rail support sections 16*d* of the plurality of rail support members 16. In this embodiment, the hammer support rail 15 is arranged with its rear end portion (its left end portion in FIG. 2) positioned above the rear ends of the keys 2.

Figure 6A:
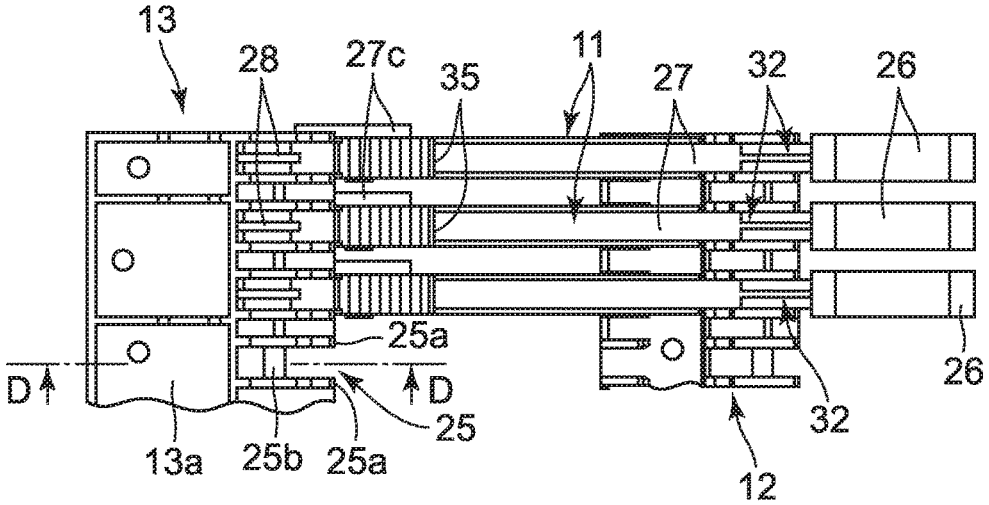
Figure 6B:
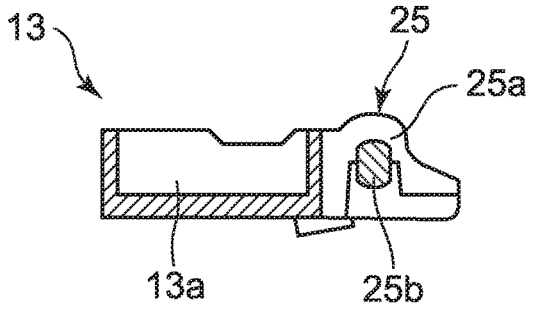

On this hammer support rail 15, the plurality of hammer holding members 13 are mounted along the array direction of the keys 2, as shown in FIG. 2 and FIG. 3. The hammer holding members 13 are constituted by hard synthetic resin such as ABS resin, and includes a rail-shaped body plate 13*a* whose top is open and shaft support sections 25, as shown in FIG. 6A and FIG. 6B. The shaft support sections 25 are integrally provided for each group of about ten keys 2 along the array direction of the keys 2, on the front end of the rail-shaped body plate 13*a*.

Each of the shaft support sections 25 prevents the rolling of the corresponding hammer member 11 by the hammer member 11 being rotatably mounted thereon, as shown in FIG. 6A and FIG. 6B. That is, each shaft support section 25 has a pair of guide walls 25*a* and a hammer holding shaft 25*b* provided between the pair of guide walls 25*a*.

These guide wall 25*a* are provided corresponding to the plurality of hammer members 11, on rear end portions (right end portions in FIG. 6B) of the body plate 13*a*, as shown in FIG. 6A and FIG. 6B. The pair of guide walls 25*a* serves as a guide section which rotatably guides a hammer fitting section 28 of the corresponding hammer member 11 with the hammer fitting section 28 of the hammer member 11 being slidably interposed therebetween.

As with each transmission holding shaft 18*b*, each hammer holding shaft 25*b* has a substantially round-bar shape, and has a non-circular shape in cross section because both sides of its outer peripheral surface are cut out, as shown in FIG. 63. In this embodiment, the hammer holding shaft 25*b* is arranged on the hammer support rail 15 with it corresponding to an area above a rear end portion of the transmission body section 20, i.e., between the capstan 23 on the key 2 and the rear end of the key 2 in the front and rear direction of the key 2, as shown in FIG. 2 and FIG. 3.

Figure 7A:
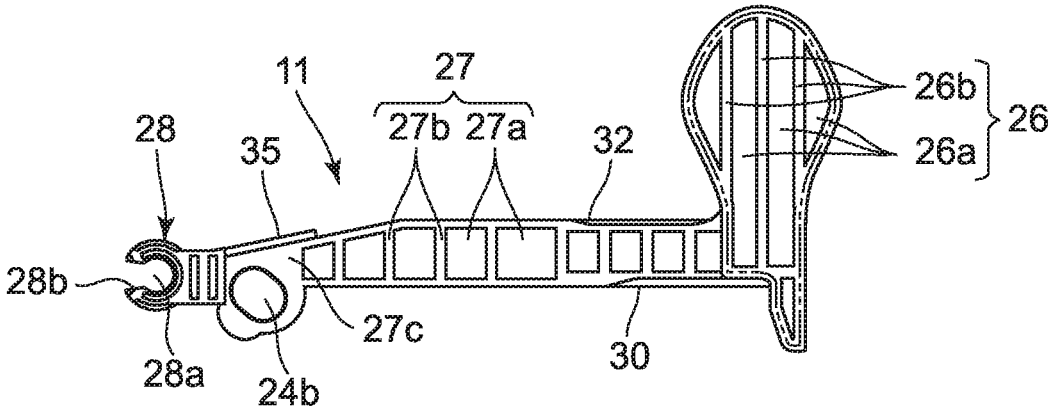
Figure 7B:
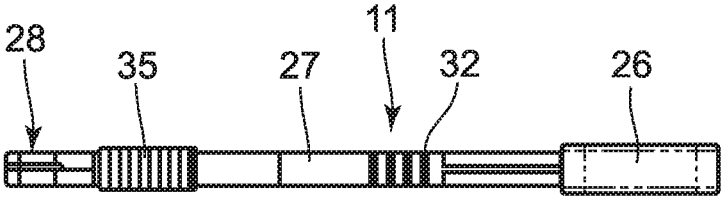

Each hammer member 11 is constituted by hard synthetic resin such as ABS resin, and includes a hammer head 26 and a hammer arm 27 which are integrally formed, as shown in FIG. 7A and FIG. 7B. The hammer head 26 has a scoop-shaped vertical plate section 26*a* and a plurality of rib sections 26*b*. The plurality of rib sections 26*b* are provided on an outer peripheral portion and both side surfaces of the vertical plate section 26*a*. The hammer head 26 is structured such that the weight of the hammer member 11 is adjusted by the shape of the scoop-shaped vertical plate section 26*a* and the formation density of the plurality of rib sections 26*b*. These hammer heads 26 are arranged in a middle area in the direction perpendicular to the array direction of the keys 2 and located above the key support shafts 4*a* and 4*b* which support the keys 2.

The hammer arm 27 has a lateral plate section 27*a* whose length in the front and rear direction is larger than the length of the transmission member 10 in the front and rear direction and rib sections 27*b* provided on an outer peripheral portion and both side surfaces of the lateral plate section 27*a*, as shown in FIG. 2, FIG. 3, and FIG. 7. On a rear end portion (a left end portion in FIG. 7A) of the hammer arm 27, the hammer fitting section 28 serving as a hammer rotation center of the hammer member 11, which is rotatably mounted on the hammer holding member 13, is provided.

This hammer fitting section 28 is formed in an inverted C shape as a whole, and projects backward on the rear end portion of the hammer arm 27, as shown in FIG. 7A and FIG. 7B. That is, the hammer fitting section 23 is provided such that its thickness in the array direction of the keys 2 is substantially equal to a length between the pair of guide walls 25*a*, and is slidably inserted between the pair of guide walls 20, as shown in FIG. 6A.

Also, the hammer fitting section 28 has a fitting hole 28*a* which is provided in its center and into which the hammer holding shaft 25*b* of the hammer holding member 13 is fitted as shown in FIG. 7A and FIG. 78, and an insertion port 28*b* which is provided in its portion around the fitting hole 28*a*, i.e., its rear portion around the fitting hole 28*a* and into which the hammer holding shaft 25*b* is removably inserted.

This hammer fitting section 28 is rotatably mounted on the hammer holding shaft 25*b* by the hammer holding shaft 25*b* being inserted into the fitting hole 28*a* via the insertion port 28*b*, as shown in FIG. 7A and FIG. 78. Also, this hammer fitting section 28 is arranged above the rear end of the transmission body section 20, i.e., above the area between the capstan 23 on the key 2 and the rear end of the key 2 in the front and rear direction of the key 2, as shown in FIG. 2 and FIG. 3.

Also, on the lower rear end of the hammer arm 27, a mounting section 27*c* is provided projecting downward, as shown in FIG. 7A and FIG. 7B. More specifically, the mounting section 27*c* is opposed to a side surface of the support section 20*c* on the transmission member 10 and moved in the vertical direction along the side surface of the support section 20*c*. Also, the mounting section 27*c* is provided with an interlock hole 24*b* into which the interlock projecting section 24*a* of an interlock section 24 described below is inserted.

Also, the hammer arm 27 is regulated at a lower-limit position serving as its initial position by its lower front end (lower right end in FIG. 2) coming in contact with a lower-limit stopper 30 from above, as shown in FIG. 2 and FIG. 3. More specifically, the lower-limit stopper 30 is formed of a cushion material such as felt.

This lower-limit stopper 30 is mounted on a lower-limit stopper rail 31 supported by the plurality of stopper support sections 17 provided on the transmission support rail 14, as shown in FIG. 2 and FIG. 3. As a result, by the lower front end of the hammer arm 27 coming in contact with the lower-limit stopper 30 from above, the hammer member 11 is positionally regulated at the initial position with it being inclined at its front end.

Also, an upper-limit position of the hammer arm 27 is regulated by a stopper contact section 32 on the upper front end of the hammer arm 27 coming in contact with an upper-limit stopper 33 from below when the key 2 is depressed, as shown in FIG. 2, FIG. 3, and FIG. 7. The upper-limit stopper 33 is formed of a cushion material such as felt, and is mounted on the under surface of the upper-limit stopper rail 34 mounted on each of the stopper rail support sections 16*e* of the plurality of rail support members 16, as with the lower-limit stopper 30.

In this embodiment, the upper-limit stopper rail 34 is formed by a metal band plate being folded in a substantially Z shape in cross section, and is arranged over the entire length of the plurality of keys 2 in the array direction, as shown in FIG. 2, FIG. 3, and FIG. 7. As a result, the upper-limit position of the hammer member 11 is regulated by the stopper contact section 32 on the upper front end of the hammer arm 27 coming in contact with the upper-limit stopper 33 from below when the hammer arm 27 is rotated around the hammer holding shaft 25*b* in the hammer holding member 13 in the counterclockwise direction.

On the other hand, on the upper rear end of the hammer arm 27, a switch pressing section 35 is provided, as shown in FIG. 7A and FIG. 7B. On the pair of substrate support rails 37 positioned above the switch pressing section 35 on the hammer arm 27, a switch substrate 36 is arranged, as shown in FIG. 2 and FIG. 3. These substrate support rails 37 are long plates each formed in an L shape in cross section, and are arranged over the entire length of the keys 2 in the array direction.

That is, the pair of substrate support rails 37 is mounted with their respective horizontal portions being away from each other by a predetermined distance on the substrate support section 16*f* of each of the plurality of support members 16, as shown in FIG. 1 to FIG. 3. The switch substrate 36 includes a plurality of switch substrates 36, as shown in FIG. 1. That is in the present embodiment, the switch substrate 36 is divided into four switch substrates 36 each having a length corresponding to about twenty keys 2, and mounted on the pair of substrate support rails 37.

On the under surface of each switch substrate 36, rubber switches 38 are provided, as shown in FIG. 2 and FIG. 3. Each rubber switch 38 has an inverted-dome-shaped bulging section 33*a* provided on a rubber sheet elongated in the array direction of the keys 2 in a manner to correspond to each of the plurality of hammer arms 27. In the bulging section 38*a*, a plurality of movable contacts (not shown) which separably come in contact with a plurality of fixed contacts (not shown) provided on the under surface of the switch substrate 36 are provided along the front and rear direction of the hammer arms 27.

As a result of this structure, each rubber switch 38 outputs, when the corresponding hammer member 11 is rotated around the hammer holding shaft 25*b* of the hammer holding member 13 in the counterclockwise direction and the rubber switch 38 is pressed from below by the switch pressing section 35 of the hammer arm 27, a switch signal corresponding to the strength of the key depression on the key 2 by the corresponding inverted-dome-shaped bulging section 38*a* being elastically deformed and the plurality of movable contacts therein sequentially coming in contact with the corresponding fixed contacts at time intervals, as shown in FIG. 2 and FIG. 3. This switch signal is supplied to a sound source section 36*a*, and a musical sound corresponding to the strength of the key depression on the key 2 is generated.

The interlock section 24 has the interlock projecting section 24*a* which is provided on the support section 20*c* on the transmission member 10 and the interlock hole 24*b* which is provided in the mounting section 27*c* of the hammer member 11 and into which the interlock projecting section 24*a* is inserted, as shown in FIG. 2, FIG. 3, FIG. 5, and FIG. 7. The transmission member 10 and the hammer member 11 are connected to each other by the interlock projecting section 24*a* and the interlock hole 24*b*.

As a result of this structure, by the interlock projecting section 24*a* and the interlock hole 24*b*, the interlock section 24 transmits the rotating motion of the transmission member 10 corresponding to the depressed key 2 to the hammer member 11, and rotates the hammer member 11 in conjunction with the key depression operation of the key 2, as shown in FIG. 2, FIG. 3, FIG. 5, and FIG. 7.

Next, the operation of the above-described keyboard device 1 in the electronic keyboard instrument is described.

When the keyboard device 1 enters an initial state where no key depression operation is performed on the keys 2, each transmission member 10 rotates by its self weight around the transmission holding shaft 18*b* of the transmission holding section 12 in the counterclockwise direction in FIG. 2, and the transmission felt 22 provided on the under surface of the transmission body section 20 comes in contact with the capstan 23 on the corresponding key 2 from above.

Here, the weight of the transmission member 10, that is, the weight set by the shape and thickness of the vertical plate section 20*a* of the transmission body section 20 and the formation density of the plurality of rib sections 20*b* is applied to the capstan 23 on the key 2 from above. As a result, the key 2 is depressed by the transmission member 10 to rotate around the balance pins 4*a* and 4*b* in the counterclockwise direction in FIG. 2, and the rear end portion of the key 2 comes in contact with the cushion member 7 to regulate the key 2 at its initial position while regulating the transmission member 10 at its initial position.

Also, here, each hammer member 11 rotates by its self weight around the hammer holding shaft 25*b* of the hammer holding member 13 in the clockwise direction in FIG. 2, and the hammer arm 27 is regulated at its lower-limit position by coming in contact with the lower-limit stopper 36 from above. In this state, the switch pressing section 35 on the hammer member 11 is arranged at a position below and away from the rubber switch 38 on the switch substrate 36. As a result the rubber switch 38 enters a free state where the bulging section 38*a* has bulged, and enters an OFF state by the plurality of movable contacts being away from the fixed contacts (both not shown).

Next, a case where a key 2 is depressed in the above-described state so as to perform a musical performance is described.

In this case, when a key 2 is depressed, this key 2 is rotated around the balance pins 4*a* and 4*b* in the clockwise direction in FIG. 3, and the capstan 23 on the key 2 presses the transmission member 10 upward. Here, the weight of the transmission member 10 set by the shape and the thickness of the vertical plate section 20*a* of the transmission body section 20 and the formation density of the plurality of rib sections 20*b* is applied to the key 2 as an initial load.

As a result, the transmission member 10 is rotated against its self weight around the transmission holding shaft 18*b* of the transmission holding member 12 in the clockwise direction in FIG. 2. Then, the rotating motion of the transmission member 10 is transmitted to the hammer member 11 by the interlock section 24, and the hammer member 11 is pressed upward against its self weight. That is, when the transmission member 10 is rotated in the clockwise direction in FIG. 2, the interlock projecting section 24*a* of the interlock section 24 presses the interlock hole 24*b* upward along with the rotation of the transmission member 10, as shown in FIG. 3.

As a result, the hammer member 11 is rotated around the hammer holding shaft 25*b* of the hammer holding member 13 in the counterclockwise direction in FIG. 3, and applies an action load to the key 2. That is, when the hammer member 11 is rotated around the hammer holding shaft 25*b* in the counterclockwise direction in FIG. 2, an action load is applied to the key 2 by the moment of inertia of the hammer member 11. In this embodiment, the hammer arm 27 has been formed such that its length in the front and rear direction of the key 2 is larger than the length of the transmission member 10 in the front and rear direction, and the hammer head 26 has been provided on the front end of the hammer arm 27, as shown in FIG. 2.

The hammer fitting section 28 on the hammer arm 27 has been rotatably mounted on the hammer holding shaft 25*b* in this state. Accordingly, when the hammer member 11 is rotated around the hammer holding shaft 25*b* in the counterclockwise direction in FIG. 2, a moment of inertia occurs in the hammer member 11. A load caused by this moment of inertia is applied as an action load to the key 2 via the interlock section 24 and the transmission member 10. As a result, a key-touch feel close to that of an acoustic piano can be acquired.

When the hammer member 11 is rotated as described above around the hammer holding shaft 25*b* in the counterclockwise direction, the switch pressing section 35 on the hammer arm 27 presses the inverted-dome-shaped bulging section 38*a* of the rubber switch 3 provided on the switch substrate 36 from below, as shown in FIG. 3. As a result, the inverted-dome-shaped bulging section 35*a* is elastically deformed, and the plurality of movable contacts in the bulging section 38*a* sequentially comes in contact with the plurality of fixed contacts at time intervals.

Here, a switch signal corresponding to the depressed key 2 is supplied to the sound source section 36*a*, and musical sound data is generated in the sound source section 36*a*. Then, based on the generated musical sound data, a musical sound is emitted from a loudspeaker (not shown) serving as a sound emitting section. When the hammer member 11 is further rotated around the hammer holding shaft 25*b* in the counterclockwise direction, the stopper contact section 32 on the hammer arm 27 comes in contact with the upper-limit stopper 33 from below to regulate and stop the rotation of the hammer member 11 in the counterclockwise direction, as shown in FIG. 3.

Then, a key release motion (returning motion) for returning the key 2 to its initial position is started. Here, the hammer member 11 is rotated by its self weight in the clockwise direction to return to its initial position and the transmission member 10 is rotated by its self weight and the weight of the hammer member 11 in the counterclockwise direction to return to its initial position, with the interlock section 24 connecting the hammer member 11 and the transmission member 10 by the interlock projecting section 24*a* being inserted into the interlock hole 24*b*. As a result, the transmission member 10 presses the capstan 23 on the key 2 downward and the key 2 returns to the initial position, as shown in FIG. 2.

As described above, the keyboard device 1 in this electronic keyboard instrument includes the transmission members 10 each of which is rotated in the vertical direction in response to a key depression operation performed on a key 2, and the hammer members 11 each of which is rotated in response to the rotation of a transmission member 10 so as to apply an action load to a key 2, in which each hammer member 11 includes the hammer arm 27 and the hammer head 26, and the hammer fitting section 28 serving as a hammer rotation center provided on the rear end of the hammer arm 27 is arranged behind the hammer head 26. As a result of this structure, compactification of the entire keyboard device 1 can be achieved even though the lengths of the hammer members 11 in the front and rear direction of the keys 2 are long.

That is, in this keyboard device 1, by the hammer fitting section 28 that is a hammer rotation center provided on the rear end of the hammer arm 27 being arranged above the rear portion of the key 2, the hammer head 26 on the front end of the hammer arm 27 can be arranged toward the front of the key 2 even though the length of the hammer arm 27 in the front and rear direction is long. Accordingly, the hammer member 11 can be favorably arranged above the key 2 without projecting toward the rear portion of the key 2. As a result of this structure, compactification of the entire keyboard device 1 can be achieved even though the length of the hammer member 11 in the front and rear direction is long.

Also, in this keyboard device 1, each transmission member 10 includes the transmission body section 20 and the transmission fitting section 21 serving as a rotation holding section, and the transmission fitting section 21 serving as a transmission rotation center on the front end of the transmission body section 20 is arranged on the front side of the transmission body section 20, whereby the transmission member 10 can be compactly arranged below the hammer member 11.

In this embodiment, the hammer fitting section 28 of the hammer arm 27 serving as a hammer rotation center is arranged above the rear portion of the key 2. As a result, the hammer head 26 can be arranged toward the front of the key 2 and the hammer filling section 28 serving as a hammer rotation center does not project backward as compared to the rear end of the key 2. Therefore, the hammer member 11 can be reliably and favorably arranged above the key 2 even though the length of the hammer member 11 in the front and rear direction is long.

Also, the transmission fitting section 21 of the transmission member 10 serving as the transmission rotation center of the rotation holding section is arranged substantially above the balance pin 4*a* or 4*b* serving as a key support shaft that rotatably supports the key 2, and a rear portion of the transmission body section 20 is arranged close to the hammer fitting section 28 on the hammer arm 27. As a result, the transmission member 10 can be efficiently and compactly arranged in an area corresponding to an area between the balance pin 4*a* or 4*b* supporting the key 2 and the rear end of the key 2.

Also, the hammer support rail 15 which holds the hammer members 11 is arranged such that its rear end is positioned above the rear ends of the keys 2, so that the hammer support rail 15 can be favorably arranged not to project backward as compared to the rear ends of the keys 2. As a result, the hammer members 11, which are held by the hammer support rail 15, can be arranged such that their rear ends do not project backward as compared to the rear ends of the keys 2.

That is, the hammer support rail 15 is arranged behind and above the transmission members 10, the hammer holding members 13 are arranged on the top of the hammer support rail 15, and each hammer fitting section 28 serving as the rotation holding section of a hammer member 11 is rotatably mounted on the corresponding hammer holding member 13. As a result, upper rear portions of the transmission members 10 can be provided corresponding to bottom rear portions of the hammer arms 27 positioned ahead of the hammer fitting sections 28.

Accordingly, in this keyboard device 1, when the transmission members 10 are rotated in response to key depression operations on the keys 2, the hammer members 11 are rotated by upper rear portions of the transmission members 10 pressing up the rear sides of the hammer arms 27 positioned ahead of the hammer fitting sections 28, whereby the moment of inertia of each hammer member 11 can be increased. As a result, an action load can be favorably applied to each key 2.

In this embodiment, a length of the hammer arm 27 of each hammer member 11 from the hammer fitting section 28 serving as the hammer rotation center of the hammer member 11 to the hammer head 26 is larger than the length of the transmission body section 20 of each transmission member 10 in the front and rear direction. Thus, the length of the hammer arm 27 can be made sufficiently larger from an area corresponding to the rear end of the key 2 toward the front side of the key 2. In addition, even if the length of the hammer arm 27 in the front and rear direction is increased, the entire keyboard device 1 does not become large, and the compactification of the entire keyboard device 1 can be achieved.

Also, the hammer fitting section 28 serving as the hammer rotation center of the hammer member 11 is arranged closer to the rear portion of the key 2 than the capstan 23 serving as a contact section that comes in contact with the key 2, and the interlock section 24 which causes the transmission member 10 and the hammer member 11 to be interlocked with each other is arranged between the hammer fitting section 28 of the hammer member 11 and the capstan 23 on the key 2 in the front and rear direction of the key 2. As a result, the hammer member 11 can be favorably rotated by the rotating motion of the transmission member 10.

That is, in this keyboard device 1, when the transmission member 10 is rotated in response to a key depression operation, the interlock section 24 presses up the vicinity of the hammer fitting section 28 serving as the hammer rotation center of the hammer arm 27. Accordingly, the moment of inertia of the hammer member 11 can be increased. As a result, an action load can be favorably applied to the key 2. Thus, a key-touch feel close to that of an acoustic piano can be acquired.

Furthermore, in this keyboard device 1, the transmission support rail 14, which holds the transmission members 10, is supported on the balance pins 4*b* serving as key support shafts that support keys 2 on the base plate 5. Accordingly, the transmission support rail 14 can be reliably and firmly supported above the keys 2. As a result, the transmission support rail 14 can be prevented from bending and vibrating when the transmission members 10 are rotated in response to key depression operations so as to rotate the hammer members 11, whereby the transmission members 10 and the hammer members 11 can be stably rotated.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a plurality of keys;

a plurality of capstans which are provided on upper rear portions of the plurality of keys respectively;

a transmission member which includes a transmission body section located on an upper side of a capstan and a transmission fitting section rotatably mounted on a transmission holding shaft, the transmission member being rotated in response to a key depression operation performed on a key among the plurality of keys; and a hammer member which is rotated in response to rotation of the transmission member and applies an action load to the key, wherein the hammer member includes a hammer arm and a hammer head provided closer to a front side of the plurality of keys than the hammer arm, wherein the hammer arm is rotated around a hammer rotation center located closer to a rear side of the plurality of keys than the hammer arm, in response to the key depression operation performed on the key, and wherein the transmission holding shaft is located closer to the front side of the plurality of keys than the capstan, and the hammer head is located closer to the front side of the plurality of keys than the transmission holding shaft.

2. The keyboard device according to claim 1, wherein the transmission body section is rotated around a transmission rotation center located on a front side of the transmission body section in response to the key depression operation performed on the key.

3. The keyboard device according to claim 2, wherein the transmission rotation center is located ahead of the hammer rotation center in a direction perpendicular to an array direction of the plurality of keys.

4. The keyboard device according to claim 1, wherein a hammer rail which holds the hammer member is arranged behind the hammer rotation center.

5. The keyboard device according to claim 1, wherein the hammer head is arranged in a middle area in a direction perpendicular to an array direction of the plurality of keys and positioned above a key support shaft which supports the key.

6. The keyboard device according to claim 1, wherein the hammer rotation center of the hammer member is located closer to a rear side of the key than a contact section where the transmission member comes in contact with the key, and wherein an interlock section which causes the transmission member and the hammer member to be interlocked with each other is arranged between the hammer rotation center of the hammer member and the contact section in a front and rear direction of the key, the interlock section comprising an interlock projecting section provided on the transmission member and an interlock hole provided in the hammer member into which the interlock projecting section is inserted.

7. The keyboard device according to claim 1, further comprising:

an upper-limit stopper which is positioned ahead of and above the hammer rotation center and with which the hammer arm comes in contact in response to the key depression operation performed on the key.

8. The keyboard device according to claim 1, further comprising:

a lower-limit stopper which is positioned ahead of and below the hammer rotation center and with which the hammer arm comes in contact in response to the key depression operation performed on the key.

9. A keyboard instrument comprising:

the keyboard device according to claim 1; and a sound emitting section which emits a musical sound in response to the key depression operation performed on the key of the keyboard device.

10. A keyboard device comprising:

a plurality of keys;

a transmission member which is rotated in response to a key depression operation performed on a key among the plurality of keys; and a hammer member which is rotated in response to rotation of the transmission member and applies an action load to the key, wherein the hammer member includes a hammer arm and a hammer head provided on a front side of the hammer arm, wherein the hammer arm is rotated around a hammer rotation center located on a rear side of the hammer arm in response to the key depression operation performed on the key, and wherein a transmission rail which holds the transmission member is supported on a key support shaft which rotatably supports the key.

* * * * *